US007562919B2

(12) United States Patent
Lawley

(10) Patent No.: US 7,562,919 B2
(45) Date of Patent: Jul. 21, 2009

(54) LIFTING EYE RELEASING ORIENTATION APPARATUS WITH CABLE GUIDING FEATURE

(75) Inventor: Derek Trent Lawley, Auckland (NZ)

(73) Assignee: ITW Zealand Limited, Penrose (NZ)

( * ) Notice: Subject to any disclaimer, the term of this patent is extended or adjusted under 35 U.S.C. 154(b) by 0 days.

(21) Appl. No.: 10/488,467

(22) PCT Filed: Sep. 5, 2002

(86) PCT No.: PCT/NZ02/00171

§ 371 (c)(1),
(2), (4) Date: Sep. 21, 2004

(87) PCT Pub. No.: WO03/021059

PCT Pub. Date: Mar. 13, 2003

(65) Prior Publication Data

US 2005/0017521 A1 Jan. 27, 2005

(30) Foreign Application Priority Data

Sep. 5, 2001 (NZ) ..... 514030
Oct. 29, 2001 (NZ) ..... 515071

(51) Int. Cl.
*B66C 1/66* (2006.01)

(52) U.S. Cl. ..... 294/1.1; 294/89

(58) Field of Classification Search ..... 294/89, 294/90, 1.1; 52/125.2, 125.4, 125.5
See application file for complete search history.

(56) References Cited

U.S. PATENT DOCUMENTS

| | | | | | |
|---|---|---|---|---|---|
| 2,736,500 | A | | 2/1956 | Coffing | |
| 3,883,170 | A | * | 5/1975 | Fricker et al. | 294/89 |
| 4,173,367 | A | * | 11/1979 | Haeussler | 294/89 |
| 4,367,892 | A | * | 1/1983 | Holt | 294/89 |
| 4,368,914 | A | * | 1/1983 | Truitt et al. | 294/89 |
| 4,398,762 | A | * | 8/1983 | Haeussler et al. | 294/89 |
| 4,437,642 | A | * | 3/1984 | Holt | 249/175 |
| 4,671,554 | A | * | 6/1987 | Lancelot | 294/89 |
| 4,769,960 | A | * | 9/1988 | Zipf et al. | 294/89 |
| 6,142,546 | A | * | 11/2000 | Hansort | 294/89 |
| 6,647,674 | B1 | * | 11/2003 | Lancelot et al. | 294/89 |

FOREIGN PATENT DOCUMENTS

WO WO 82/01541 5/1982

* cited by examiner

*Primary Examiner*—Paul T Chin
(74) *Attorney, Agent, or Firm*—Lowe Hauptman Ham & Berner, LLP

(57) ABSTRACT

An orientation apparatus for aiding the release of a lifting eye from a lifting anchor has a concave web with an open slot. The slot is configured to locate around a lifting anchor located within a hemispherical recess of a concrete element. The web is shaped to fit into the recess and so that a lifting eye, which engages the lifting anchor, can seat therein and be held so that its axis of rotation is prevented from rotating relative to the web. A shank which is integral with the web extends over a surface of the concrete element and away from the recess, and has a cable guide at a distal end trough which a cable, which is adapted for connection to the lifting eye and which can be pulled to rotate the lifting eye to a release position, is guided.

10 Claims, 11 Drawing Sheets

LIFTING EYE RELEASING ORIENTATION APPARATUS WITH CABLE GUIDING FEATURE

CROSS REFERENCE TO RELATED APPLICATIONS

This is a National Phase Application of a Patent Cooperation Treaty application filed on Sep. 5, 2002 (International Application No. PCT/NZ02/00171) which claims priority to NZ514030 filed on Sep. 2001 and NZ515071 filed on Oct. 29, 2001.

FIELD OF INVENTION

This invention relates to methods and apparatus for orientating, guiding or restricting the movement of a rotatable means and has been devised particularly though not necessarily solely for use in the construction industry for lifting and handling concrete elements.

BACKGROUND OF THE INVENTION

The conventional use of lengths of cable or wire cast into a concrete element, such as a concrete wall or a slab, to form a lifting hook for lifting of the element is unsafe and the hooks are prone to damage.

Modern lifting systems utilise lifting anchors which are partially cast and embedded in a concrete element that is to be lifted. The lifting anchors have a forged head which is exposed to engage with a hooking device mown as a 'lifting eye'. Recesses are commonly provided on the surface of the concrete element at locations where there is a lifting anchor such that the exposed portion including the forged head of the individual lifting anchors is recessed below the concrete surface being protected from damages.

A recess is commonly formed and shaped by a recess former which is provided to encapsulate the exposed portion of the lifting anchor during curing of the concrete element. Known recess formers are in the shape of either a hemisphere or a truncated hemisphere with two planar sides. It is practically convenient and cheap to cast a hemispherical recess using a hemispherical recess former rather than formers having planar sides. Recess formers are often subject to problems of orientation and difficulties arise when disengaging the lifting eye. This is due to the fact that the lifting eye swivels about the head of the anchor but can only be disengaged once it is orientated. After a concrete wall has been leveraged up, it is simply too dangerous and impractical for a workman to climb up a ladder and manually release the lifting eye. It is therefore desirable that the lifting eye can be disconnected remotely.

Previous attempts to solve this problem have involved the use of truncated hemispherical formers with planar sides. These improved treated formers are advantageous in that the flat sides of a recess that is shaped by these formers restrict the rotational movement of the lifting eye. As a result, the lifting eye can be remotely released by pulling a cable or a wire which is connected thereto, since the rotational movement of the lifting eye is unidirectionally restricted. However, truncated hemispherical formers are often expensive to manufacture, and vulnerable to inaccuracies when orientated within a concrete element. The truncated formers are also often subject to movement during curing, the result of which requires the positioning of a supporting means, for example a chair, which carries each former, so as to consolidate the position of the former. Furthermore, given the nature of the common construction workplace, the supporting means having a former therein are often susceptible to inadvertent shifting or movement, for example, by workmen.

OBJECT

It is therefore an object of the present invention to provide an orientation apparatus which will overcome the foregoing disadvantages in a simple yet effective manner or which will at least provide the public with a useful choice.

STATEMENT OF THE INVENTION

Accordingly in one aspect the present invention consists in orientation apparatus which includes at least one locating men, a guiding manes, and a control men guided by the gliding means and connectable in use to a separate rotatable means, the locating means being adapted to restrict the rotational movement in use of the rotatable means to rotational movement about a selected axis of rotation.

Accordingly in another aspect the present invention consists in a method of restricting the rotational movement of a rotatable means, the method including the steps of providing orientation apparatus which includes at least one locating means, providing a guiding means, and providing a control means guided by the guiding means and connectable in use to a separate rotatable means, the locating means being adapted to restrict the rotational movement in use of the rotatable means to rotational movement about a selected axis of rotation.

Accordingly in a further aspect the present invention consists in orientation apparatus including a remotely operable control means which is adapted to allow or effect remote disengagement of a rotatable means engageable in use with an anchoring means.

To those skilled in the art to which the invention relates, many changes in construction and widely differing embodiments and applications of the invention will suggest themselves without departing from the scope of the invention as defined in the appended claims. The disclosures and the description herein are purely illustrative add are not intended to be in any sense limiting.

DRAWING DESCRIPTIONS

One presently preferred embodiment of the invention will now be described with reference to the accompanying drawings, wherein, FIG. 1 is a perspective view of an orientation apparatus in accordance with the present invention.

FIG. 2 is a perspective view showing a lifting system into which the orientation apparatus of FIG. 1 is adapted to fit.

FIG. 2*a* is a perspective view of a recess former which forms the recess of FIG. 3.

FIG. 3 is a perspective view of the orientation apparatus of FIG. 1 sitting in the recess of a concrete wall FIG. 3*a* is a cross sectional view showing the orientation apparatus of FIG. 1 sitting in the recess of a concrete wall.

FIGS. 4, 4*a*, 5 and 6 arc side elevations showing the lifting system with the orientation apparatus of FIG. 1 in different orientations.

FIG. 6*a* is a cross sectional side elevation of the orientation apparatus of FIG. 1 incorporated into the lifting system of FIG. 2.

Figure 1:
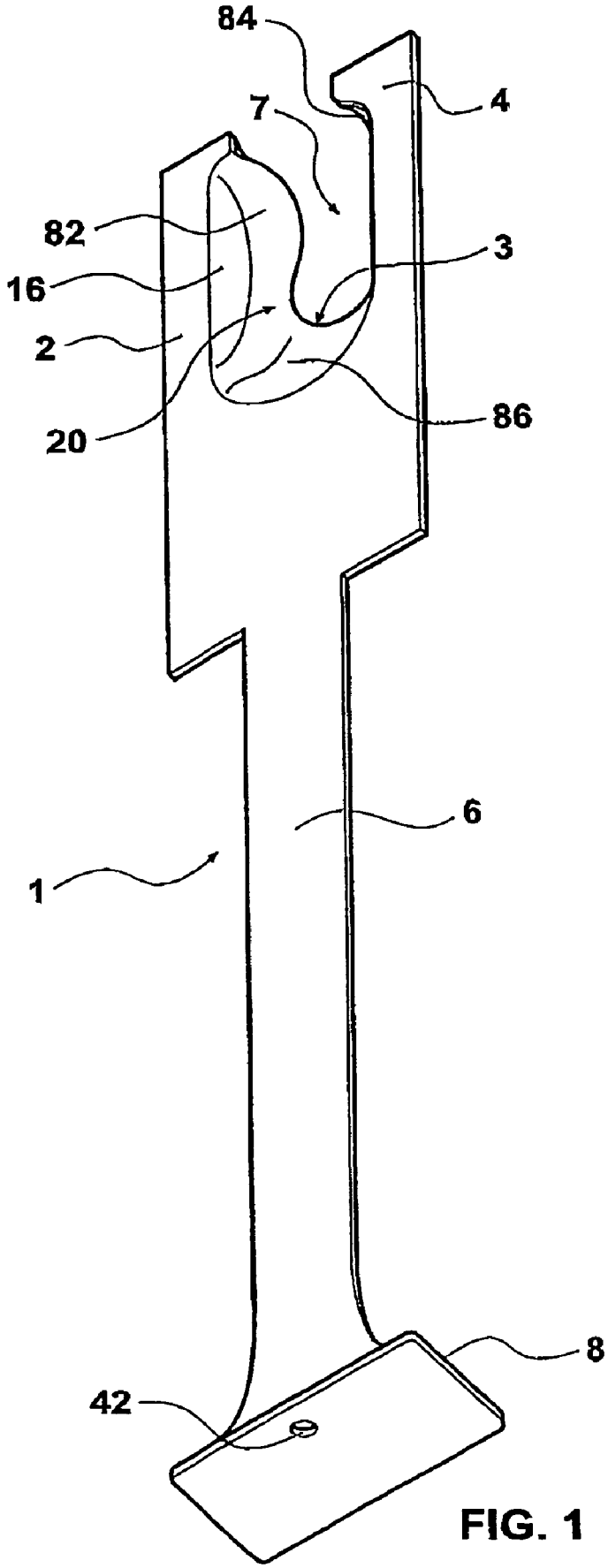
Figure 10C:
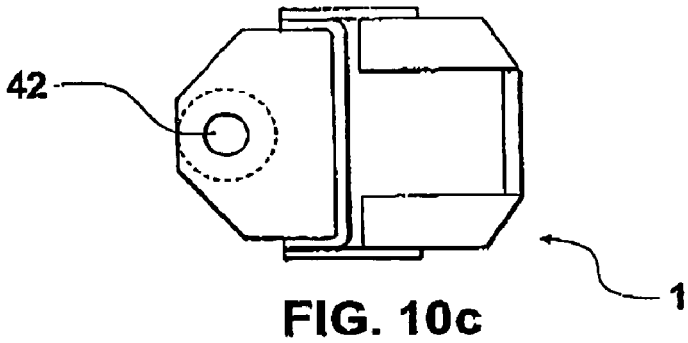
Figure 10A:
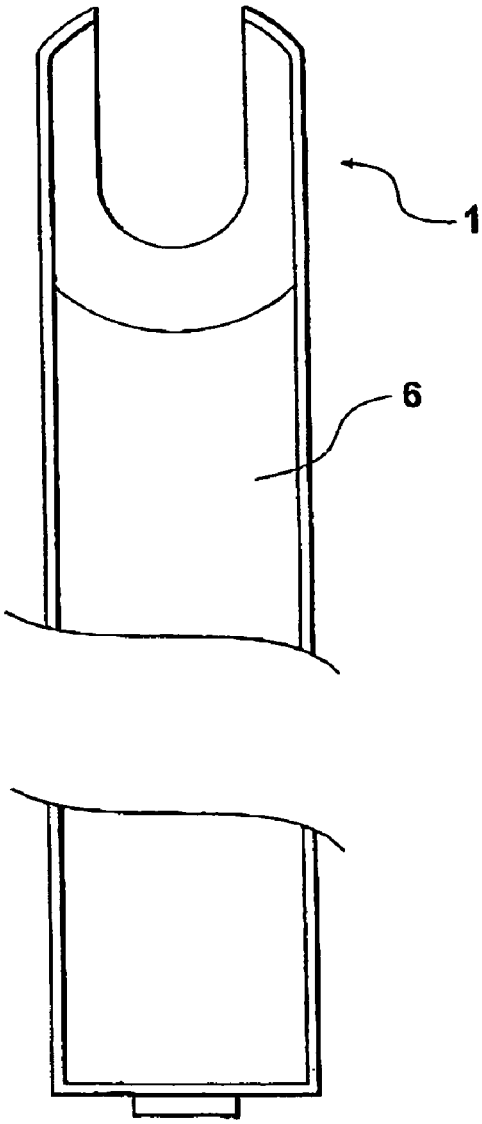

FIG. 10*a* is a plan view of the most preferred embodiment of the orientation apparatus of FIG. 1.

Figure 10B:
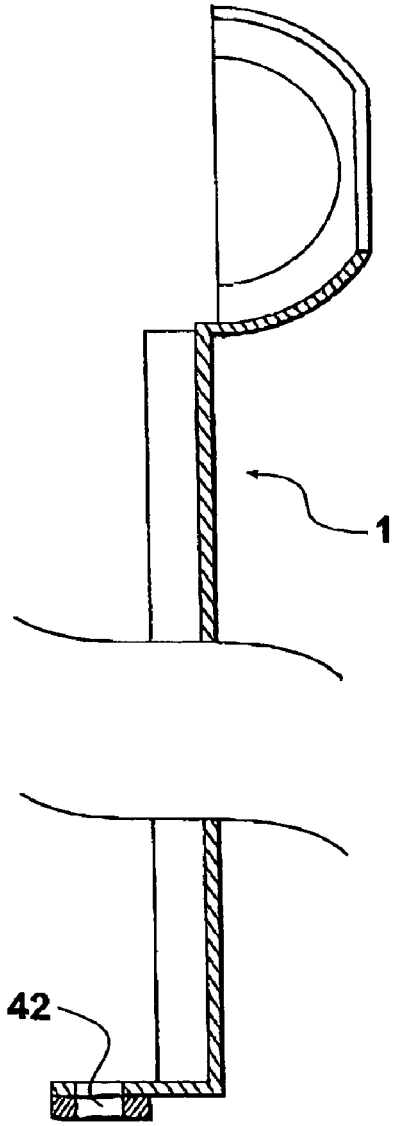

FIG. 10*b* is a side elevation of the lost preferred embodiment of the orientation apparatus of FIG. 1.

FIG. 10*c* is an end view of the most preferred embodiment of the orientation apparatus of FIG. 1.

Figure 2:
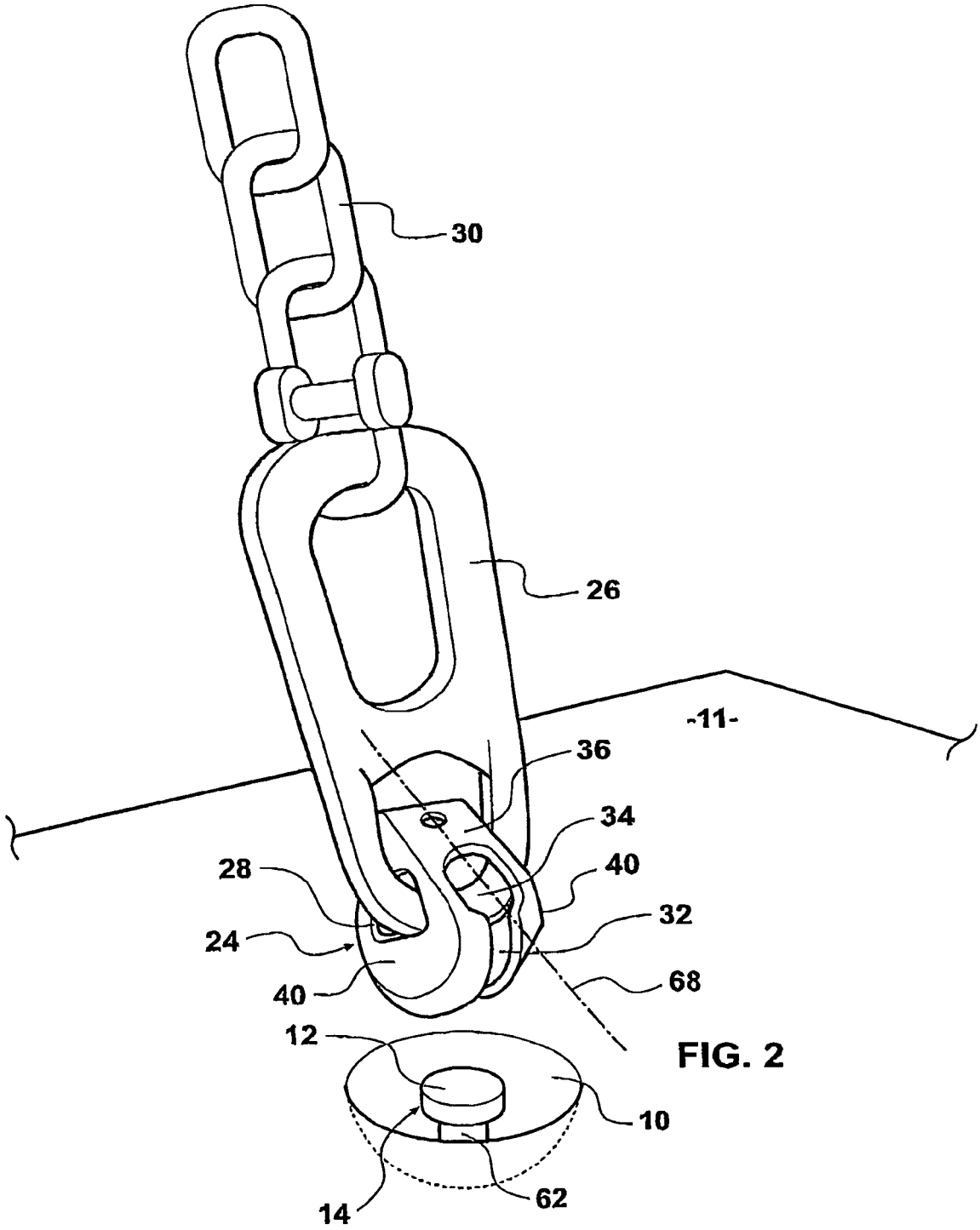
Figure 11:
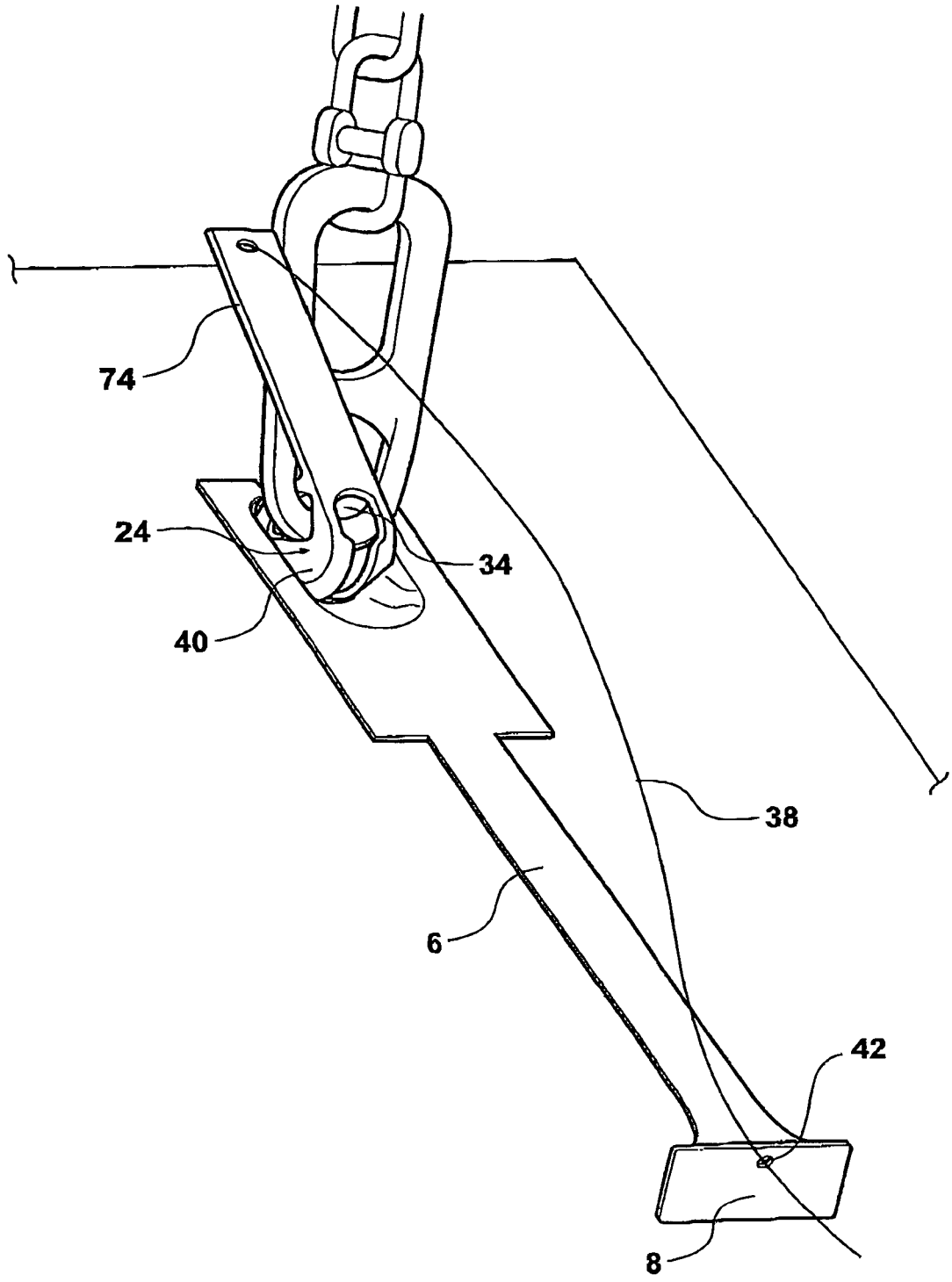

FIG. 11 is a perspective view showing the preferred embodiment of the yoke of the lifting system of FIG. 2.

Figure 12:
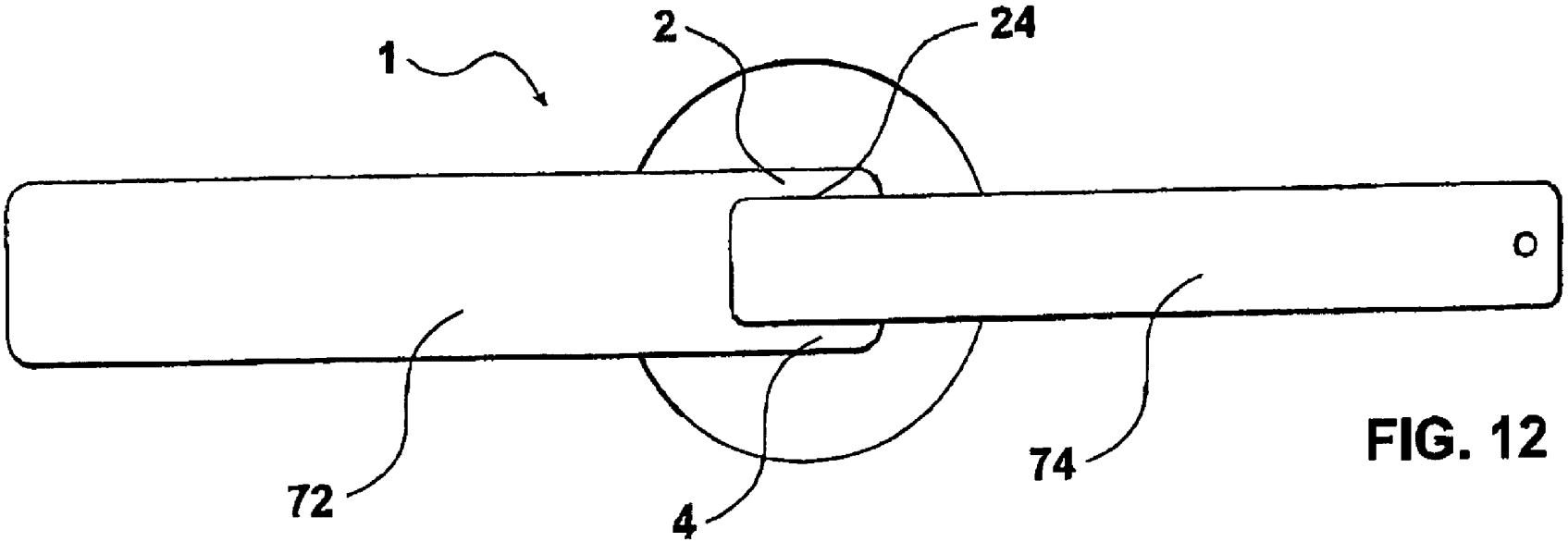

FIG. 12 is a schematic drawing illustrating a specific disposition of the orientation apparatus of FIG. 11*a* and the yoke of FIG. 12.

DETAILED DESCRIPTION

Referring to FIG. 1, a perspective view of orientation apparatus generally referenced 1 is shown. The apparatus 1 is formed to provide locating means which can be in the shape of a bifurcated fork (ie. for example blunt prongs or tines 2 and 4), a web 3 with side portions 82 and 84 and a middle portion 86. An elongate member (eg. a shank) 6 which extends from the fork is connected to an end piece 8. The end piece 8 carries guiding means such as an aperture 42 in the end piece 8. The web 3 defines a cavity 20 having an open slot 7. The cavity 20 of the apparatus is adapted to fit into a hemispherical recess 10, which is shown in FIG. 2, of an element such as a concrete slab or wall 11 to be lifted. FIG. 2 illustrates a lifting system that is commonly used in the constriction industry, including an anchor 14 which is partly embedded in the recess 10 of a concrete wall or slab 11, a rotatable means (referred to as a yoke or sheave) 24 which is the main part of an engaging means commonly referred to as a lifting eye), a lifting shackle 26 and a metallic chain 30. It can be observed in FIG. 2 that the head 12 of an anchor 14 projects into the recess 10, which is cast by a hemispherical recess former (refer to FIG. 2*a* ), in a concrete slab 11.

Figure 2A:
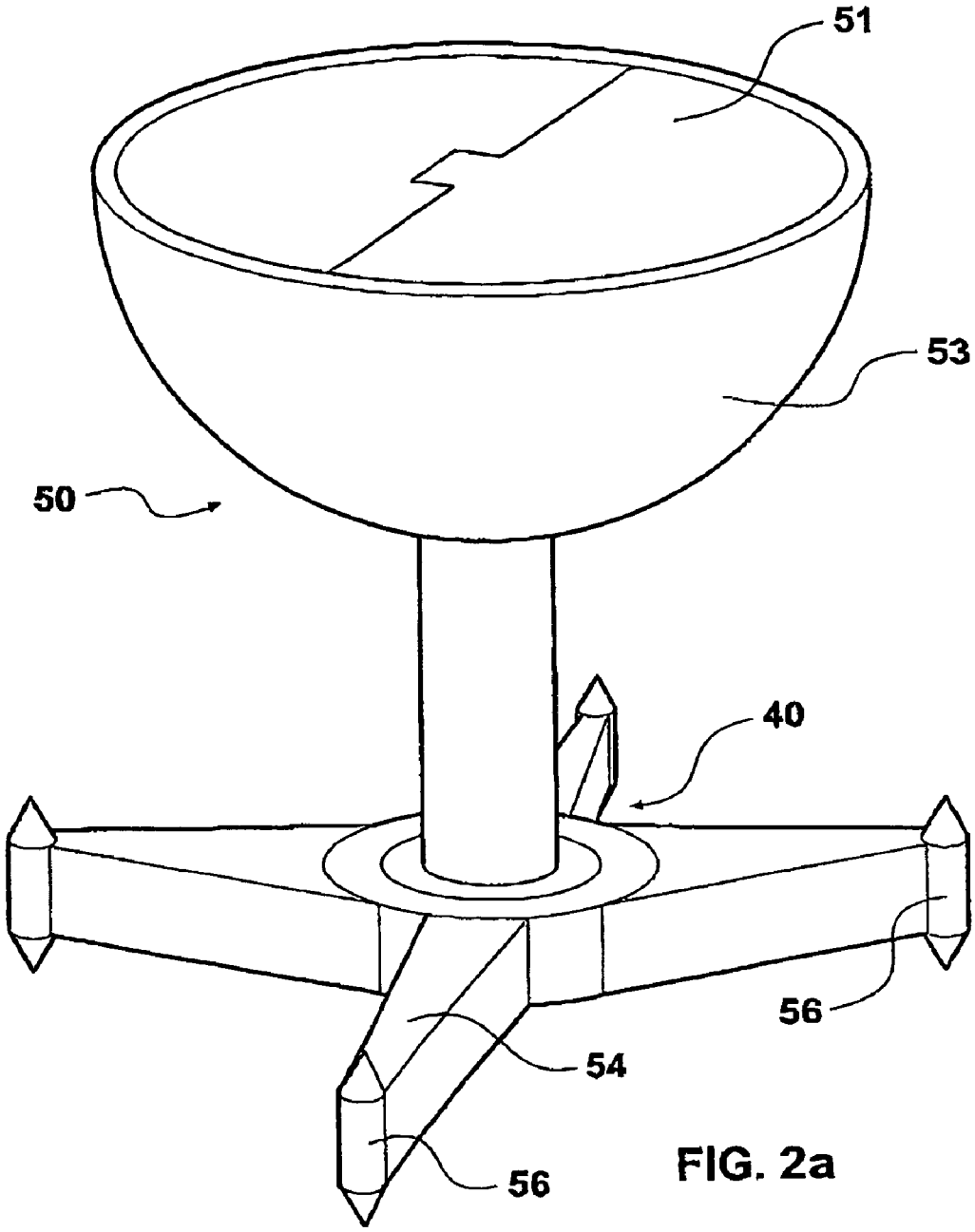

FIG. 2*a* shows a hemispherical recess former 50 which includes a cup and a lid 51 when in use encapsulating the top portion of the anchor 14 (including the head 12). Preferably a footing 52 with feet 54 having locating toes which preferably comprise spikes 56 is mounted on the base of anchor 14 so as to fix and locate the position of the anchor 14 and the recess 10 while the moist concrete slab 11 is setting. The recess former 50 can be broken open by a screw driver or the like after the concrete slab 11 has solidified.

Figure 3:
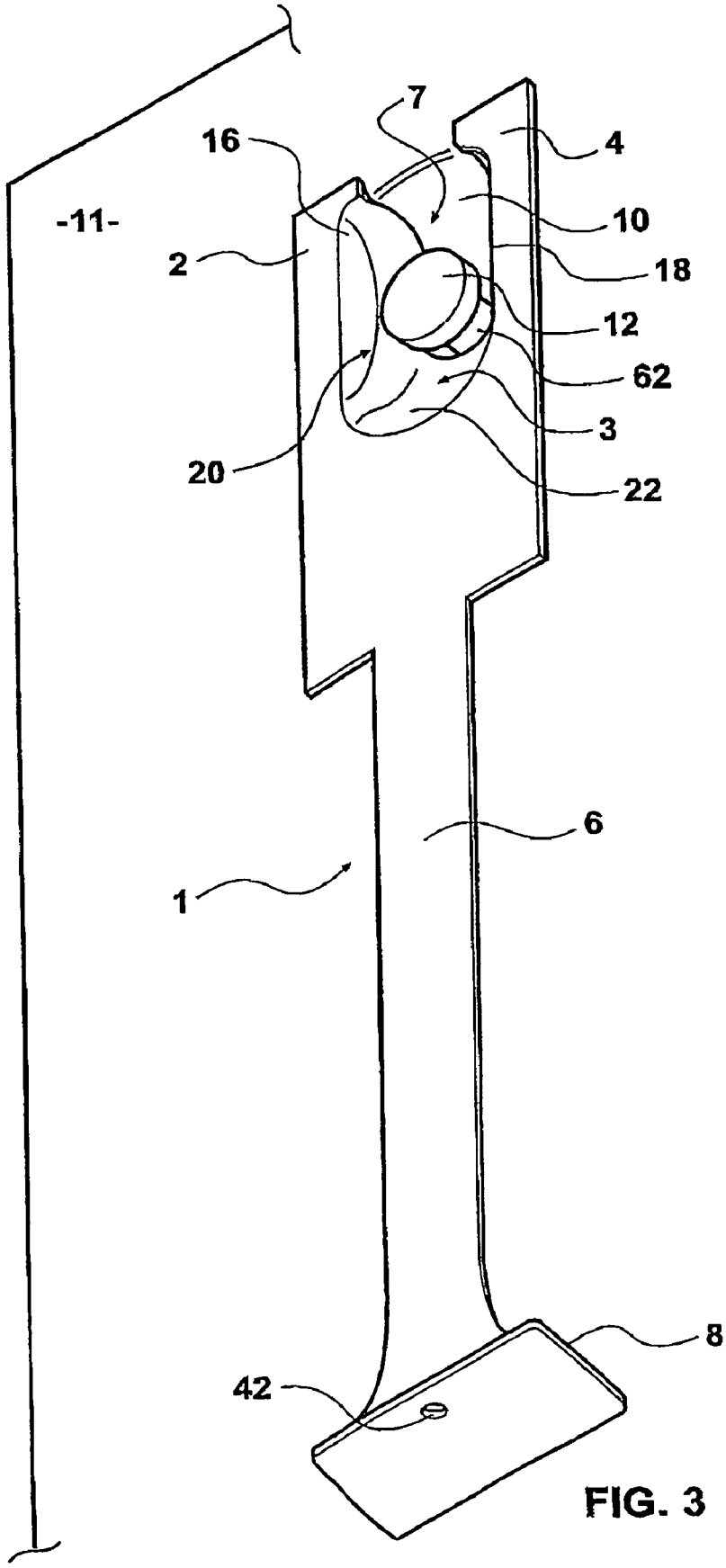
Figure 3A:
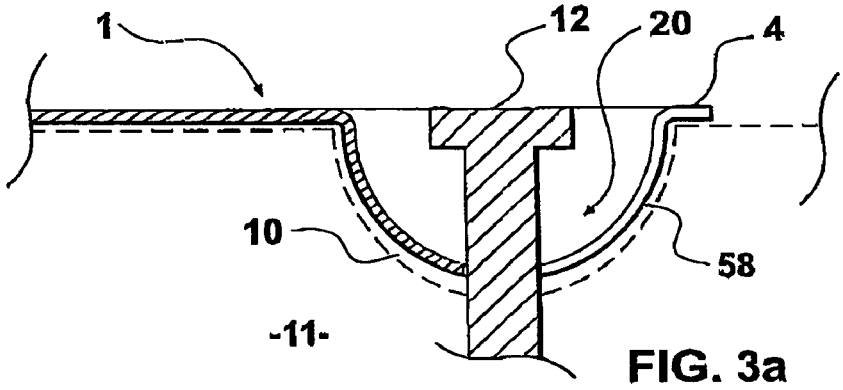

Also, referring to FIG. 3, in operation, the prongs or lines 2 and 4 of the orientation apparatus 1 shown in FIG. 1 are fitted into the recess 10 of the concrete slab 11. The construction and arrangement of the orientation apparatus 1 and the recess 10 are more clearly shown in FIG. 3*a*. The tines 2 & 4 which have planar inner side surfaces 16 & 18, define the cavity 20 with a curved base 58. The yoke 24 is then provided to engage with the protruding head 12 in the slab 11.

Referring back to FIG. 2, the lifting eye which comprises a coupling piece or yoke 24 and a lifting shackle 26 is shown. The yoke 24 is in the shape of a sheave with substantially planar sides 40 and is provided to couple with the head 12 of the anchor 14. The yoke 24 has two truncated faces 28 and a hole (not clearly visible in FIG. 2) through which the lifting shackle 26 passes. The lifting shackle 26 is in turn connected to a chain 30 (eg. metallic chain) of a crane rig for hoisting the concrete slab 11. The bottom portion of the yoke 24 provides a downwardly open slot 32 of dimensions corresponding to those of the head 12 and the shank 62 of the anchor 14. The cross section of slot 32 provides a substantially T-section cylindrical groove that is open to the outside via an opening 34.

The following describes the operation of the lifting system.

Figure 4:
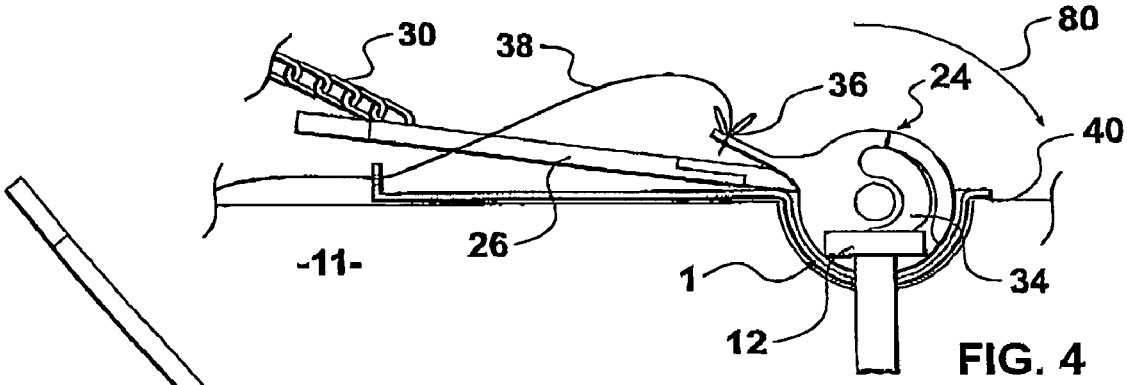
Figure 4A:
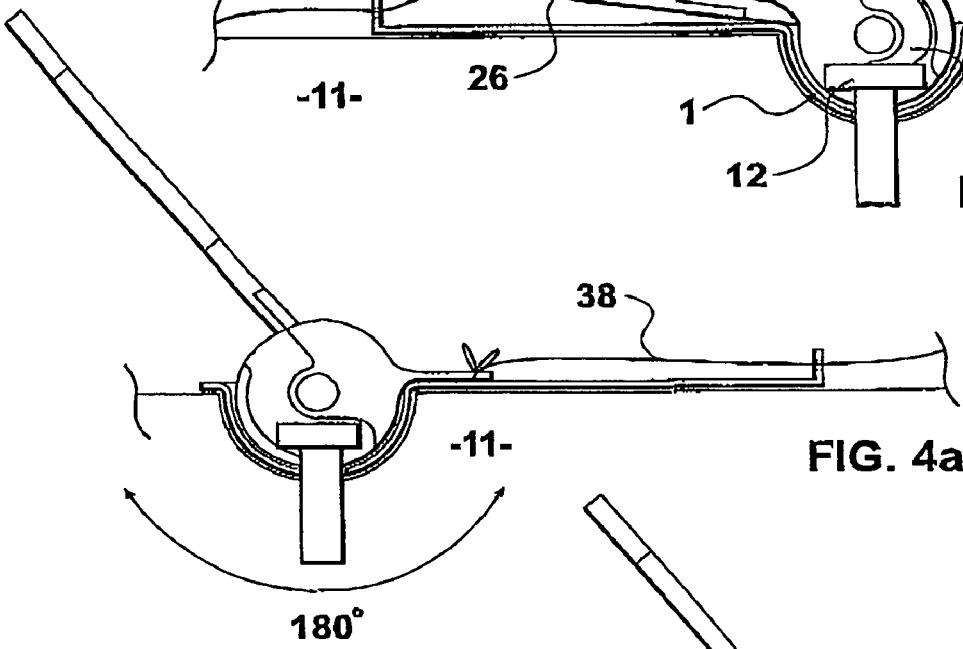

Referring to FIGS. 2 and 4, the yoke 24 of the lifting system is connected to the anchor head 12 in the slab 11 by admitting the anchor head 12 into the slot 32 of the yoke 24 via the opening 34. The yoke 24 preferably has a spur 36 which is then flipped or rotated in the direction of arrow 80 (refer to FIG. 4) until it rests on the outer surface 40 of the concrete element 11. This step is essential to the displacement of the opening 34 to allow the anchor head 12 to be received into the slot 32. It is important to note that later for the yoke 24 to be successfully disengaged remotely (after the concrete element 11 is erected or transported) with the assistance of the orientation apparatus 1, the yoke 24 should be orientated and disposed such that spur 36 (prior to being rotated) is on the same side as the shank 6 as shown in FIG. 4, instead of in a position that is 180° away from the shank 6 as shown in FIG. 4*a*.

Figure 5:
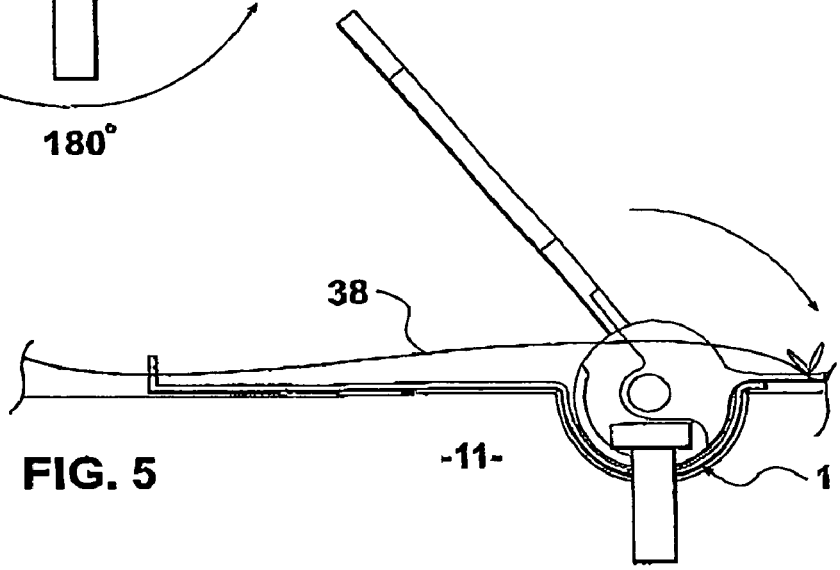
Figure 6:
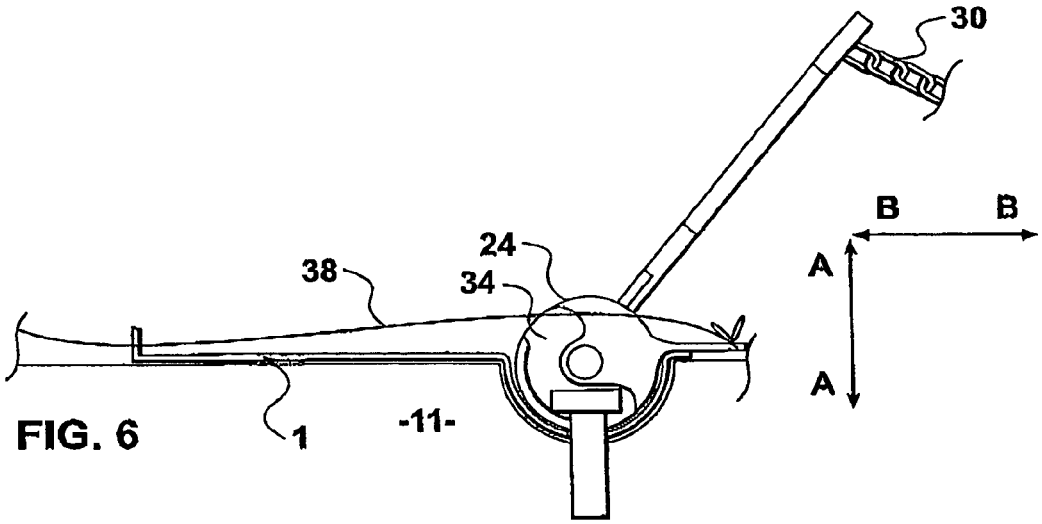
Figure 6A:
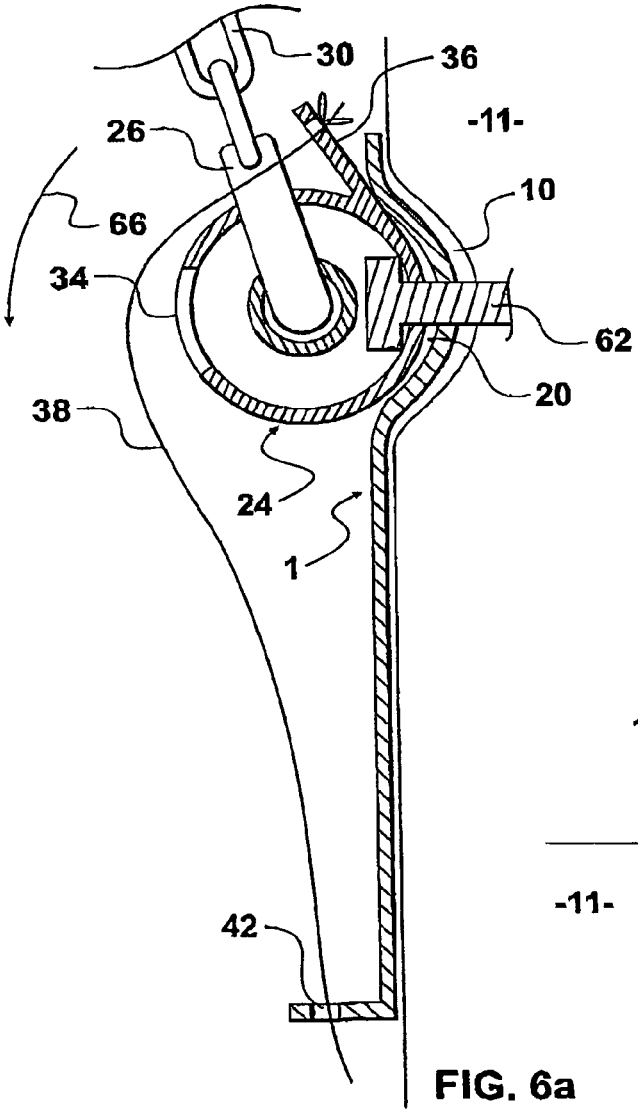

Referring now to FIG. 5, once the yoke 24 is engaged with the anchor head 12, a load can be applied from any direction in order to lift or tilt the concrete element 11. FIGS. 6 and 6*a* demonstrate how the concrete wall 11 can be lifted from any direction. It can be seen that the lifting shackle 26 can deflect depending on the direction from which the force or load is exerted. In other words, the yoke (ie. the lifting eye) 24 has been designed in such a way that it cannot accidentally disengage while under load. The design and mechanism of the lifting eye will not be discussed in detail as they are outside the scope of the current invention being known apparatus.

Turning to FIG. 6*a*, a cross sectional side view of the orientation apparatus 1 in use is shown. The concrete element 11 is shown in a substantially upright disposition. Once the load is taken off the shackle 26, an operator, from a remote location, can pull a control means (such as a remote-controllable cable or wire or the like) 38 which is connected to the spur 36, passing through and guided by the guiding means (ie. an aperture) 42 (as shown in FIG. 1) provided in the end piece 8. As a consequence, the yoke 24 (ie. the lifting eye) will rotate in the direction of arrow 66, thereby enabling the yoke 24 to be remotely released from the head 12 of the anchor 14 via the opening 34.

Figure 7:
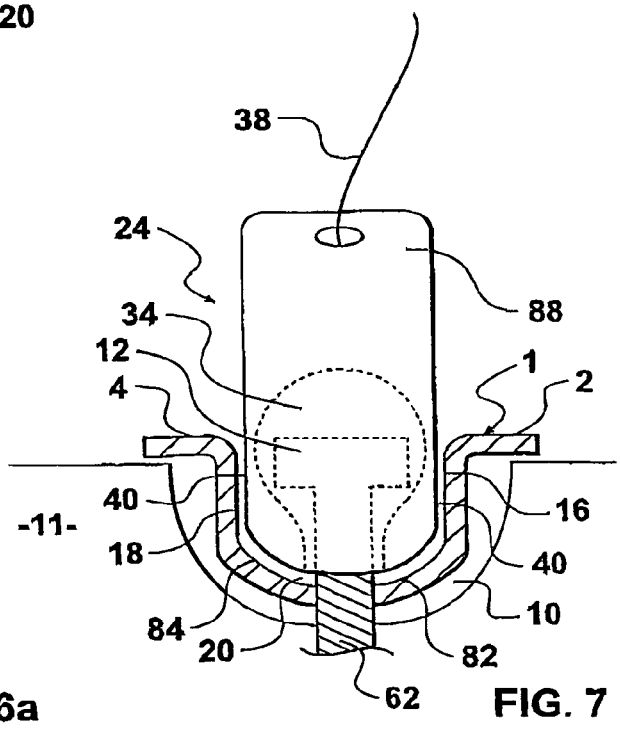
FIG. 7 is a front view illustrating how the orientation apparatus of FIG. 1 is fitted into the lifting system of FIG. 2.

It should be understood that when restricted by the prongs or tines 2 and 4 of the orientation apparatus 1, the motion of the yoke 24 can only be on the plane defined by the lines A-A and B-B, as shown in FIG. 6. It is important to note that the opening 34 is provided along the line of symmetry 68 (refer back to FIG. 2) of the yoke 24. The yoke 24 therefore has to be properly orientated as described above such that it is restricted from any rotational movement about the anchor 14 or else it cannot disengage from the anchor head 12. Referring to FIGS. 6*a* and 7, the orientation apparatus 1 being fitted into the recess 10, defines the cavity 20 which has planar sides 16 and 18 that abut the outer surfaces 40 of the yoke 24 once the yoke 24 is engaged with the anchor head 12. As soon as the lifting eye disengages with the anchor head 12, the orientation apparatus 1 will fall out of the recess 10 automatically wider gravitational force being guided by the cable or wire 38 enables retrieval and collection of the apparatus 1 by the operator on the ground.

Figure 8:
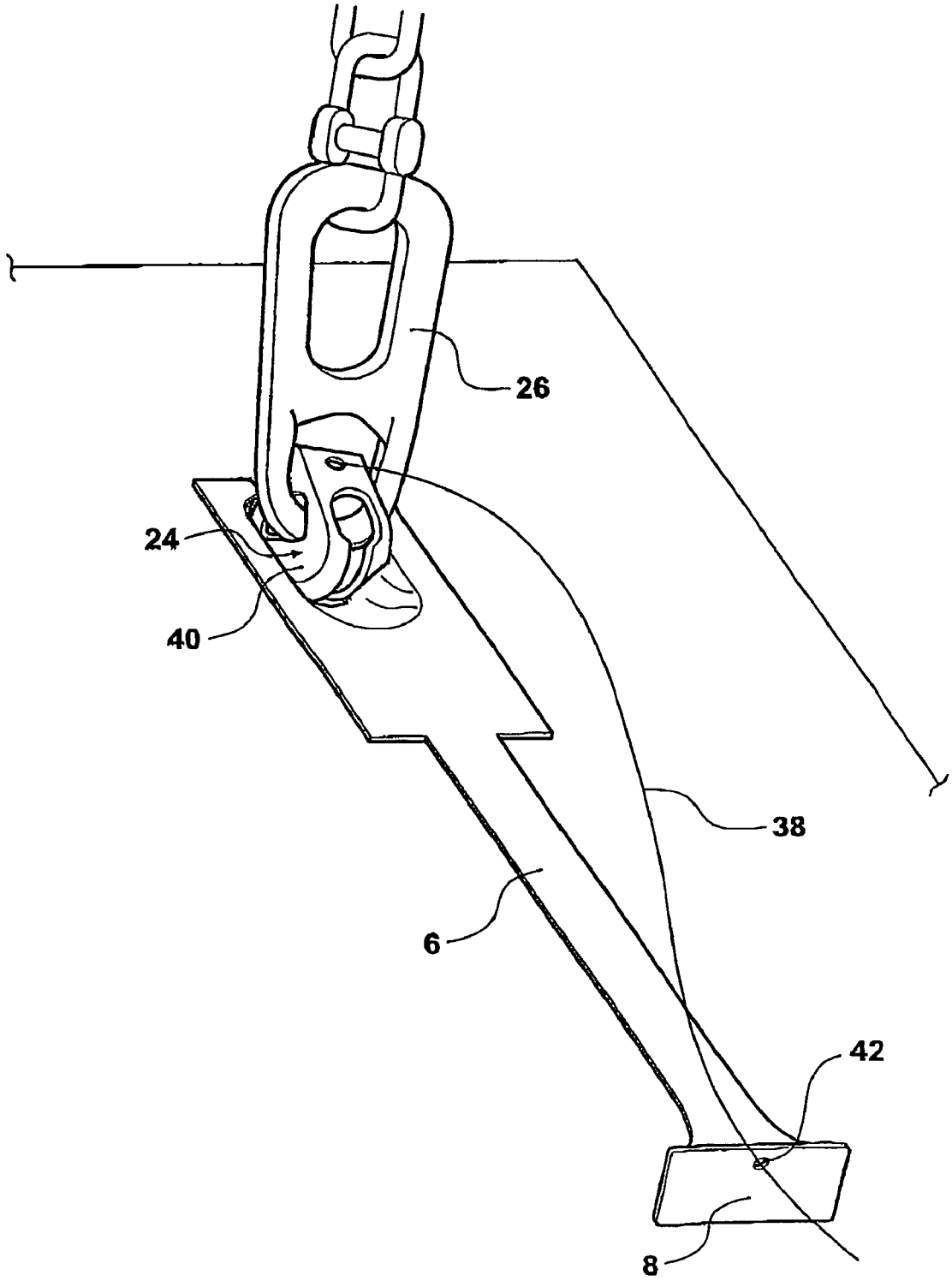
FIG. 8 is a perspective view illustrating how the orientation apparatus of FIG. 1 is fitted into the lifting system of FIG. 2.

FIG. 7 is a front view showing how the orientation apparatus 1 fits into the lifting system. The planar internal surfaces 18 & 16 of the prongs or tines 4 & 2 abut the lateral surfaces 40 of the yoke 24 respectively so as to restrict the yoke 24 to rotational movements only about a selected axis of rotation. The selected axis of rotation is preferably substantially perpendicular to the anchor 14. The front surface 88 of the yoke 24 abuts the middle and side portions 86, 82 and 84 of the web 3 such that the orientation apparatus 1 is locked in place without being able to fall out of the recess 10. The yoke 24 is essentially free to rotate about the anchor 14 with the orientation apparatus 1, but will be restricted to only about an axis that is perpendicular to the planar surfaces 16 & 18 when the orientation apparatus 1 is locked in a specific position Turning to FIG. 8, a perspective view of the orientation apparatus 1 being incorporated into the lifting system is shown. After the concrete element 11 has been leveraged up to a substantially upright position or transported to any desired disposition or location, it can be appreciated that once the load is Hen off the shackle 26, the yoke 24 (ie. the lifting eye) may swivel together with the orientation apparatus 1 about the anchor means 14 in either directions indicated by arrows 70 in the plan view of FIG. 9. With the control means (ie. the cable, wire or tendon) 38, the operator can pull the yoke 24 and the orientation apparatus 1 to the can be upright position, as shown in FIG. 10, as well as aligning them at the same time. The control means 38, being connected to the yoke 24 and pulled, is coincident with the length of the elongate member (eg. the shank) 6 of the apparatus 1. Regardless of the orientation of the yoke 24 and of the orientation apparatus 1, which are random as soon as the load is taken off the shackle 26, the operator can "regulate" the orientation of the yoke 24 as well as the orientation apparatus 1, and cause the yoke 24 to rotate in the direction as shown by arrow 66 (as shown in FIG. 6*a* ) at the same time by pulling the cable or wire 38 from the ground until the anchor head 12 disengages from the lifting eye via the opening 34.

Variations

Figure 9:
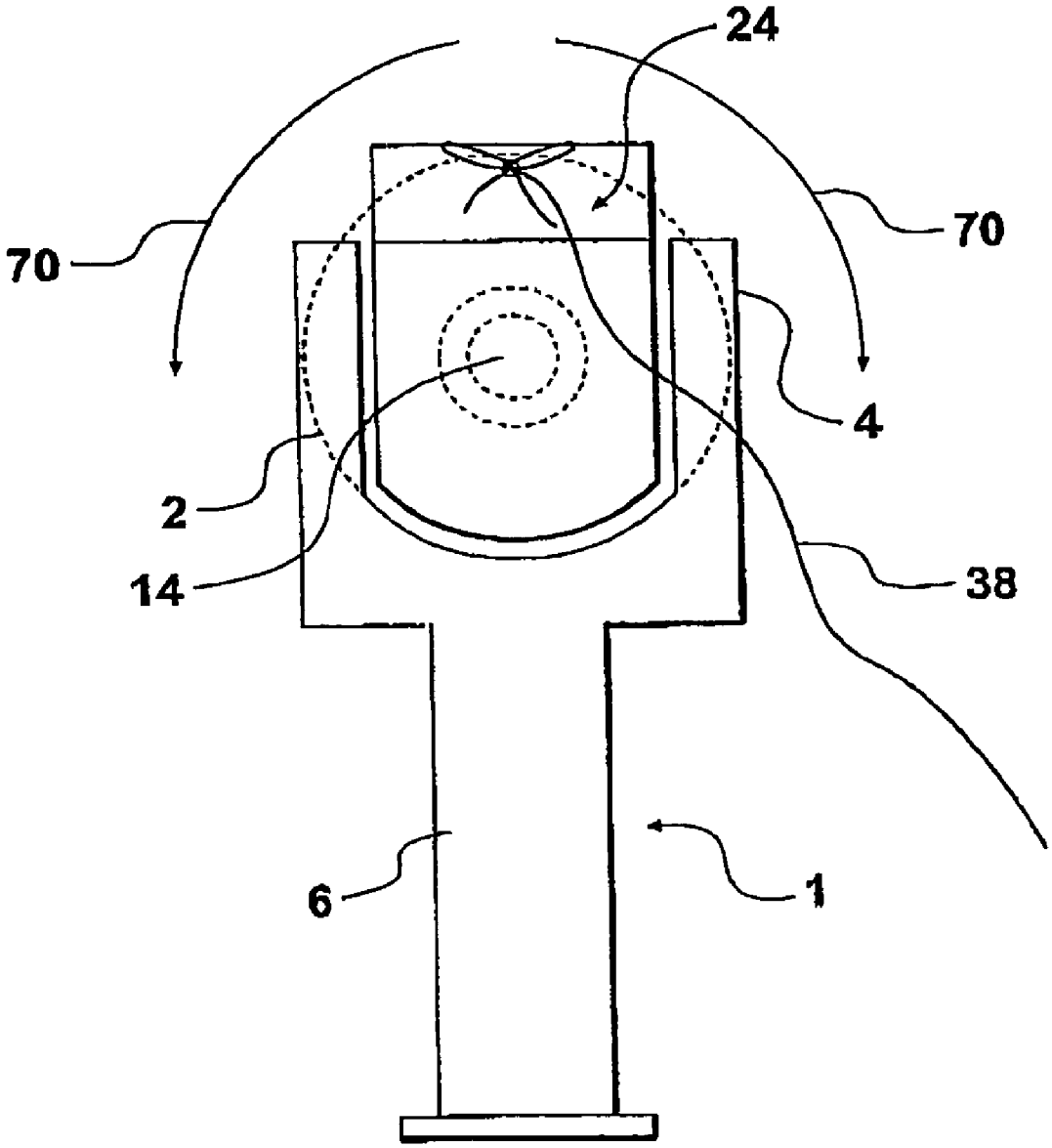
FIG. 9 is a plan view of the orientation apparatus of FIG. 1 when in use.

The plan view, side elevation and front view of the most preferred embodiment of the orientation apparatus 1 are shown respectively in FIGS. 10*a, b* and *c*. It will be appreciated that the length and shape of the shank 6 may vary. All elongate shank is preferred to make it easier for the operator to monitor the rotational movement, and judge the orientation, of the orientation apparatus 1 from the ground. Also, the spur 36 may optionally be substituted by an elongate member 74 as shown in FIG. 11. This embodiment is beneficial in that the lifting eye will automatically rotate to a position that allows disengagement with the anchor head 12 (not shown) via the opening 34, due to the fact that the elongate member 74 (which is preferred to be made of a heavy metal) will drop due to its own weight once the load is taken off the shackle 26 and the orientation of the orientation apparatus 1 is "regulated" to the substantially upright position (as shown in FIG. 9). The lifting eye may not disengage wit the anchor head 12 unless or until a pulling force is exerted by the operator. The elongate member 74 is also advantageous in that it gives the lifting eye more leverage. It should however be noted that the elongate member 74 may counterweight the shank 6 of the orientation apparatus 1. As a result, the orientation apparatus 1 and the elongate member 74 may end up in a disposition as shown in FIG. 11 rather than the orientation apparatus falling on the weight of its shank 72 to automatically end up in the substantially vertical position as shown in FIG. 9 after the load is taken off the shackle 26. This however may be overcome or regulated by the pulling force exerted by the operator.

Advantages

It can thus be seen that at least in the preferred form of the invention an orientation apparatus is provided which offers the following advantages:

1. impeding multidirectional movement of the rotatable yoke of the lifting system;
2. allowing successful remote release of the rotatable yoke and/or the orientation device;
3. easy and economical to manufacture;
4. allowing use of non-directional hemispherical recesses to be used with simplified chairs which are also easy and economical to manufacture;
5. easy to implement and operate, without the need of altering the construction of the existing lifting system.

The invention claimed is:

1. An orientation apparatus for aiding the release of a lifting eye from a lifting anchor, the orientation apparatus, which does not form part of the lifting eye or a shackle to which the lifting eye is pivotally connected, comprising:

a lifting eye receiving web separate from the lifting eye and having:

an open slot configured to locate around a lifting anchor located within a recess in a concrete element, a lifting eye receiving concave surface against which the lifting eye, when engaged with a lifting anchor set in the concrete element, seats and is relatively movable thereto, a shank portion undetachably attached to the web and configured to rest on a surface of the concrete element during rotation of the lifting eye, and a cable guide at an end of the shank portion through which a cable, adapted for connection to the lifting eye, is guided.

2. An orientation apparatus as claimed in claim 1, wherein a recess occupying portion of the web is provided with a guide arrangement configured to restrict or confine substantially to a single plane, the movement of the lifting eye during lifting eye-lifting anchor release.

3. An orientation apparatus as claimed in claim 2, wherein the cable guide of the orientation apparatus is configured to be distal from the hemispherical recess occupying portion of the concrete element.

4. An orientation apparatus as claimed in claim 2, wherein the guide arrangement is configured to restrict movement of the lifting eye to a predetermined relationship with the cable guide at the end of the shank.

5. An orientation apparatus as claimed in claim 2, wherein the lifting eye is restricted by the guide arrangement to rotate about an axis which is essentially normal to a longitudinal direction of the shank.

6. An orientation apparatus as claimed in claim 2, wherein the predetermined relationship is such that the cable, when pulled, produces a tension that acts essentially tangentially to an axis of rotation of the lifting eye.

7. An orientation apparatus as claimed in claim 1, wherein the shank portion comprises an elongate member.

8. An orientation apparatus as claimed in claim 1, wherein the cable is adapted to enable retrieval of the orientation apparatus.

9. An orientation apparatus as claimed in claim 1, wherein the shank portion which rests on the surface of the concrete element is slidable over the surface.

10. The orientation apparatus as claimed in claim 1, wherein an entirety of said shank portion is adapted to be always positioned outside the recess and along the surface of the concrete element.

* * * * *